US011840080B2

(12) United States Patent
Wallsten et al.

(10) Patent No.: US 11,840,080 B2
(45) **Date of Patent: *Dec. 12, 2023**

(54) VALVE JET PRINTER WITH INERT PLUNGER TIP

(71) Applicant: Matthews International Corporation, Pittsburgh, PA (US)

(72) Inventors: Hans Elon Wallsten, Gråbo (SE); Nils Johan Fredrik Käck, Gothenburg (SE)

(73) Assignee: Matthews International Corporation, Pittsburgh, PA (US)

( * ) Notice: Subject to any disclaimer, the term of this patent is extended or adjusted under 35 U.S.C. 154(b) by 366 days.

This patent is subject to a terminal disclaimer.

(21) Appl. No.: 17/120,998

(22) Filed: Dec. 14, 2020

(65) Prior Publication Data

US 2021/0206166 A1 Jul. 8, 2021

Related U.S. Application Data

(63) Continuation of application No. 16/741,054, filed on Jan. 13, 2020, now Pat. No. 10,864,724, which is a (Continued)

(51) Int. Cl.

| | |
|---|---|
| ***B41J 2/04*** | (2006.01) |
| ***B41J 2/14*** | (2006.01) |
| ***B41J 2/175*** | (2006.01) |

(52) U.S. Cl.

CPC . *B41J 2/14* (2013.01); *B41J 2/04* (2013.01); *B41J 2/175* (2013.01); *B41J 2/17596* (2013.01);

(Continued)

(58) Field of Classification Search

CPC ..... B41J 2/04; B41J 2/14; B41J 2/175; B41J 2/17595; B41J 2002/041; B41J 2202/05

See application file for complete search history.

(56) References Cited

U.S. PATENT DOCUMENTS

| | | | |
|---|---|---|---|
| 4,420,945 | A | 12/1983 | Dibrell |
| 4,433,551 | A | 2/1984 | Dibrell |

(Continued)

FOREIGN PATENT DOCUMENTS

| | | | |
|---|---|---|---|
| EP | 0371763 | A2 | 6/1990 |
| EP | 1990194 | A2 | 11/2008 |

(Continued)

OTHER PUBLICATIONS

European Search Report and Written Opinion dated Jun. 1, 2012 for EP2632730.

(Continued)

*Primary Examiner* — Anh T Vo

(74) *Attorney, Agent, or Firm* — DLA Piper LLP

(57) ABSTRACT

A valve jet printer includes a solenoid coil and a plunger rod having a magnetically susceptible shank. A first end of the shank and at least a portion of the shank are received within a bore of the solenoid coil. The printer also includes a nozzle including an orifice extending therethrough and a spring biasing a second end of the shank toward the nozzle. The second end of the plunger rod includes a tip formed of perfluoroelastomer (FFKM). The second end of the shank includes a cup-shaped cavity having a convex bottom and a circular side. The tip includes a concave base and an annular flange. In an assembled state, the concave base of the tip contacts the convex bottom of the cup-shaped cavity, and the end of the circular side opposite the convex bottom is rolled over the annular flange thereby securing the tip in the cup-shaped cavity.

24 Claims, 5 Drawing Sheets

Related U.S. Application Data continuation of application No. 16/113,263, filed on Aug. 27, 2018, now Pat. No. 10,532,569, which is a continuation of application No. 15/618,866, filed on Jun. 9, 2017, now Pat. No. 10,059,098, which is a continuation of application No. 14/827,682, filed on Aug. 17, 2015, now Pat. No. 9,676,184, which is a continuation of application No. 14/463,942, filed on Aug. 20, 2014, now Pat. No. 9,108,424, which is a continuation of application No. 13/282,522, filed on Oct. 27, 2011, now Pat. No. 8,820,871.

(60) Provisional application No. 61/407,082, filed on Oct. 27, 2010.

(52) U.S. Cl.
CPC ..... *B41J 2002/041* (2013.01); *B41J 2202/05* (2013.01)

(56) References Cited

U.S. PATENT DOCUMENTS

| | | | | |
|---|---|---|---|---|
| 4,449,379 | A | 5/1984 | Dibrell | |
| 4,513,575 | A | 4/1985 | Dibrell | |
| 4,513,576 | A | 4/1985 | Dibrell et al. | |
| 4,520,632 | A | 6/1985 | Dibrell | |
| 4,734,190 | A | 3/1988 | Fulton et al. | |
| 4,793,379 | A | 12/1988 | Eidsmore | |
| 4,875,058 | A | 10/1989 | Vonasek | |
| 5,533,868 | A | 7/1996 | Fassbender | |
| 5,819,799 | A | 10/1998 | O'Dell | |
| 6,540,340 | B2 | 4/2003 | Thorpe et al. | |
| 7,014,636 | B2 | 3/2006 | Gilbert | |
| 7,070,255 | B2 | 7/2006 | Nakajima | |
| 7,163,688 | B2 | 1/2007 | Peery et al. | |
| 7,231,766 | B2 | 6/2007 | Hall et al. | |
| 7,232,205 | B2 | 6/2007 | Nakajima | |
| 7,316,680 | B2 | 1/2008 | Gilbert | |
| 7,387,365 | B2 | 6/2008 | Silverbrook | |
| 7,407,241 | B2 | 8/2008 | Mutoh et al. | |
| 7,410,245 | B2 | 8/2008 | Horsnell et al. | |
| 7,628,468 | B2 | 12/2009 | Silverbrook | |
| 7,682,356 | B2 | 3/2010 | Alessi et al. | |
| 7,713,034 | B2 * | 5/2010 | Ogawa | F04B 43/025 417/413.1 |
| 7,731,336 | B2 | 6/2010 | Silverbrook | |
| 7,767,266 | B2 * | 8/2010 | Holm | B23K 3/0607 239/128 |
| 7,939,125 | B2 * | 5/2011 | Abernathy | B05C 11/1034 118/712 |
| 8,820,871 | B2 | 9/2014 | Wallsten et al. | |
| 9,108,424 | B2 | 8/2015 | Wallsten et al. | |
| 9,676,184 | B2 | 6/2017 | Wallsten et al. | |
| 10,059,098 | B2 | 8/2018 | Wallsten et al. | |
| 10,532,569 | B2 | 1/2020 | Wallsten et al. | |
| 2005/0231553 | A1 | 10/2005 | Horsnell et al. | |
| 2006/0201613 | A1 | 9/2006 | Minowa et al. | |
| 2009/0079792 | A1 | 3/2009 | Koizumi | |
| 2009/0118711 | A1 | 5/2009 | Haase et al. | |
| 2009/0167818 | A1 * | 7/2009 | Morita | B41J 2/14201 239/91 |
| 2009/0202608 | A1 | 8/2009 | Alessi et al. | |

FOREIGN PATENT DOCUMENTS

| | | | |
|---|---|---|---|
| EP | 2632730 | A2 | 9/2013 |
| EP | 2632730 | B1 | 8/2019 |
| JP | 8230203 | A | 9/1996 |
| WO | 2012/058373 | A3 | 3/2012 |

OTHER PUBLICATIONS

European Search Report and Written Opinion for EP19189298 dated Nov. 29, 2019.
International Search Report dated Jun. 1, 2012 for PCT/US2011/057996 (2 pages).
Introducing Kalrez.RTM. Spectrum.TM. 7090: The latest product for high durometer/low compression set, and rapid gas decompression resistance, DupontPerformance Elastomers, Jan. 2009, 2 pages.
Kalrez Fluoroelastomer Semifinished Parts and Shapes in Synonym List KRZ042, Material Safety Data Sheet, Feb. 15, 2007, 15 pages.
Kalrez perfluoroelastomer semi-finished parts and shapes, Material Safety Data Sheet, Feb. 2, 2009, http://msds.dupont.com/msds/pdfs/EN/PEN.sub.--09004a358045cac9.pdf, 6 pages.
Kalrez.RTM. Spectrum.TM. 7090 Technical Information, Brochure, Jun. 2007, 2 pages.
Supplemental European Search Report and Written Opinion for EP11837056 dated Feb. 21, 2018.

* cited by examiner

VALVE JET PRINTER WITH INERT PLUNGER TIP

CROSS REFERENCE TO RELATED APPLICATIONS

This application is a continuation of U.S. patent application Ser. No. 16/741,054, filed Jan. 13, 2020, and issued as U.S. Pat. No. 10,864,724, which is a continuation of U.S. patent application Ser. No. 16/113,263, filed Aug. 27, 2018, and issued as U.S. Pat. No. 10,532,569, which is a continuation of U.S. patent application Ser. No. 15/618,866, filed Jun. 9, 2017, and issued as U.S. Pat. No. 10,059,098, which is a continuation of U.S. patent application Ser. No. 14/827,682, filed Aug. 17, 2015, and issued as U.S. Pat. No. 9,676,184, which is a continuation of U.S. patent application Ser. No. 14/463,942, filed Aug. 20, 2014, and issued as U.S. Pat. No. 9,108,424, which is a continuation of U.S. patent application Ser. No. 13/282,522, filed Oct. 27, 2011 and issued as U.S. Pat. No. 8,820,871, and claims priority to U.S. Provisional Application No. 61/407,082, filed Oct. 27, 2010. The contents of each of these applications are hereby incorporated by reference herein in their entireties.

BACKGROUND OF THE INVENTION

Field of the Invention

The present invention relates to valve jet printers.

Description of Related Art

Valve jet printers are known in the art and are utilized for depositing ink patterns onto a substrate that is moving relative to said printer. A controller controls the deposition pattern of the ink on the substrate as a function of the relative movement between the substrate and the valve jet printer.

Inks utilized with valve jet printers are known to include one or more solvents that are reactive to one or more materials of the valve jet printers. Typical solvents utilized in ink dispensed by valve jet printers can include: MEK; N-propanol; Iso-propanol; Ethyl Acetate; Acetone; and Ethanol. These inks may also include other solvents.

Ink which includes one or more of these solvents can react with the material forming one or more components of a valve jet printer during dispensing of the ink. The component(s) will thus require service and/or replacement after some time of exposure to this solvent-containing ink in order to maintain the quality of deposition of the ink. Because time and expense is required to service and/or replace solvent-reactive components of a valve jet printer, there is a need to form said components to better withstand exposure to the solvents.

SUMMARY OF THE INVENTION

The invention is a valve jet printer comprising: a solenoid coil; a plunger rod having a magnetically susceptible shank with a first end and a second end at opposite ends thereof, the first end and at least a portion of the shank received within a bore of the solenoid coil; a nozzle including an orifice extending therethrough; and a spring biasing the second end of the shank toward the nozzle, wherein the second end of the plunger rod includes a tip formed of perfluoroelastomer (FFKM).

The shank can be formed of stainless steel that has been heat treated to make the shank magnetically susceptible.

Absent electrical power being supplied to the solenoid coil, the spring can bias the tip into contact with the orifice of the nozzle. In response to electrical power being supplied to the solenoid coil, the tip can move away from the orifice of the nozzle against the bias of the spring.

In response to the tip being biased into contact with the orifice of the nozzle, the tip deforms from its original shape to form a seal with the orifice of the nozzle. In response to the tip moving away from the orifice of the nozzle, the tip resumes its original shape.

The tip can include one or more of the following properties: a Shore A hardness between 65 and 95; a tensile strength of approximately 2,000 lb/in$^2$; a maximum continuous service temperature of approximately 325° C.; a 50% modulus of 15.5 MPa; a tensile strength at break of 22.75 MPa; a surface smoothness between 20 and 50 micro inches; a thickness between 0.3 and 0.6 mm; an elongation at break of 75%; and a compression set of 12% for 70 hours at 204° C., or 23% for 70 hours at 260° C.

The second end of the shank can include a cup-shaped cavity having a convex bottom and a circular side. The tip can include a concave base and an annular flange. In an assembled state of the tip and the second end of the shank, the concave base of the tip can contact the convex bottom of the cup-shaped cavity, and the end of the circular side opposite the convex bottom can be rolled into contact with the annular flange to secure the tip in the cup-shaped cavity.

The tip comprises: perfluoroalkylpolyether in the range between 5-8 wt %; and perfluoroelastomer <97 wt %. The tip can further comprise one or more of the following: polyamide fibers <20 wt %; polytetrafluoroethylene <20 wt %; and microcrystalline silica <15 wt %.

The invention is also a valve jet printer comprising: a frame defining an ink cavity, a plurality of ink jets supported by the frame, and a controller operating under the control of a control program for selectively causing electrical power to be supplied to or withheld from each solenoid coil in coordination with movement of a substrate relative to the ink jets.

Each ink jet can include: a solenoid coil defining a bore, a plunger rod having a first end, a second end and a magnetically susceptible shank extending therebetween, the first end and at least a portion of the shank received within the bore of the solenoid coil, the second end received in the ink cavity; a nozzle including an orifice in alignment with a longitudinal axis of the plunger rod; and a spring biasing the second end of the shank toward the nozzle, wherein the second end of the plunger rod includes a tip formed of perfluoroelastomer (FFKM).

The controller can be operative for causing the ink jets to dispense ink disposed in the ink cavity onto the substrate via the orifices in accordance with instructions programmed into the controller.

In response to the absence of electrical power being supplied to the solenoid coil of an ink jet, the spring biases the tip of the ink jet into sealing contact with the orifice of the nozzle. In response to electrical power being supplied to the solenoid coil of an ink jet, the tip of the ink jet moves away from the orifice of the nozzle against the bias of the spring.

In response to the spring biasing the tip into contact with the orifice of the nozzle, the tip deforms from its original shape to form a seal with the orifice of the nozzle. In response to the tip moving away from the orifice, the tip resumes its un-deformed shape.

The shank can be formed of stainless steel that has been heat treated to make the shank magnetically susceptible.

The tip can have one or more of the following properties; a Shore A hardness between 65 and 95; a tensile strength of approximately 2,000 lb/in$^2$; a maximum continuous service temperature of approximately 325° C.; a 50% modulus of 15.5 MPa; a tensile strength at break of 22.75 MPa; an elongation at break of 75%; and a compression set of 12% for 70 hours at 204° C., or 23% for 70 hours at 260° C.

The second end of the shank can include a cup-shaped cavity having a convex bottom and a circular side, which receives the tip. The tip can include a concave base and an annular flange. In an assembled state, the concave base of the tip can contact the convex bottom of the tip, and the circular side can be rolled over the annular flange to secure the tip in the cup-shaped cavity.

DETAILED DESCRIPTION OF THE INVENTION

The present invention will be described with reference to the accompanying figures where like reference numbers correspond to like elements.

Figure 1:
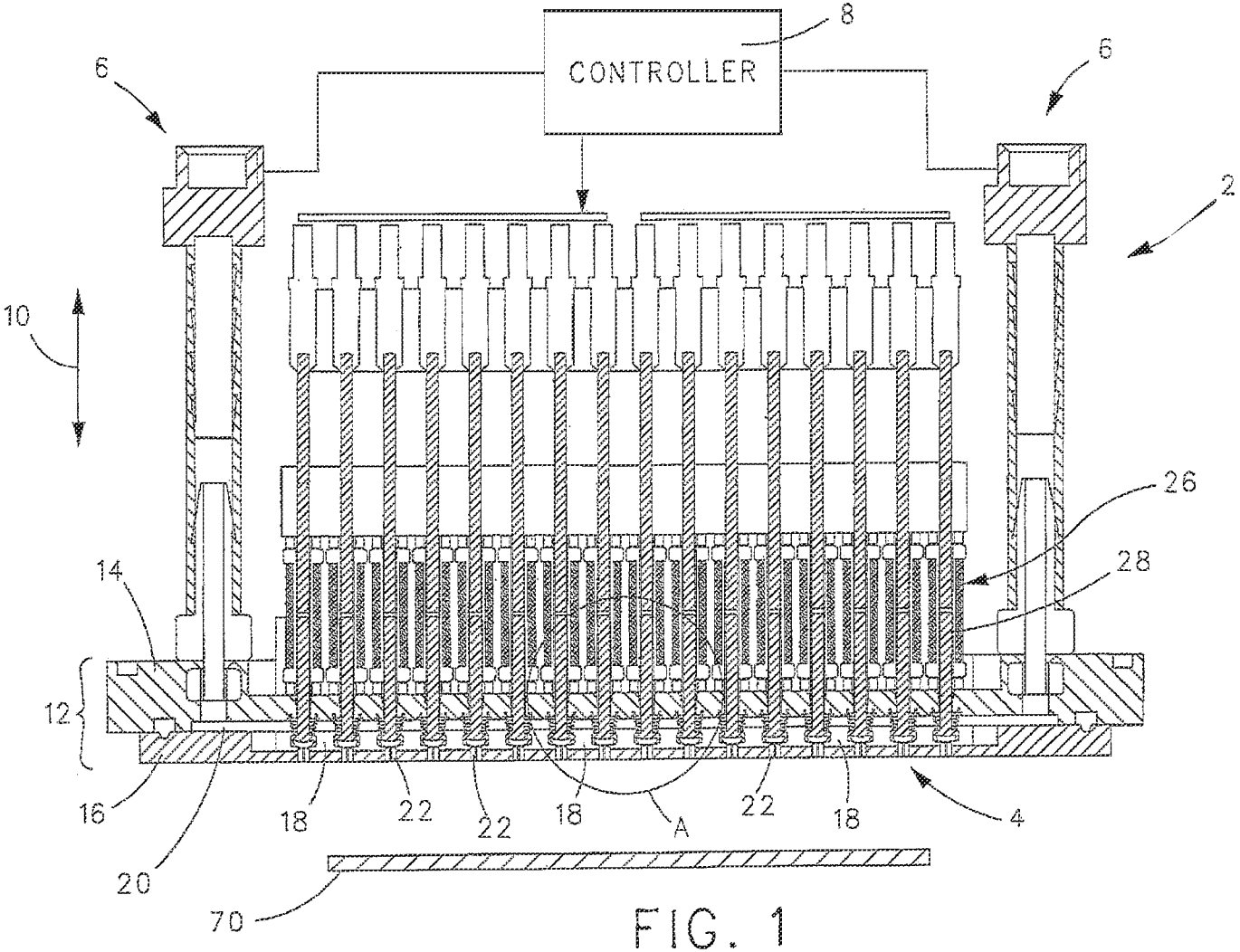
FIG. 1 is a cross-sectional view of a valve jet printer including a block diagram of a controller utilized to control the operation of said valve jet printer.

With reference to FIG. 1, a valve jet printer 2 includes a printer head assembly 4 that is coupled to one or more means for extending and retracting 6, each of which is operative under the control of a controller 8 which operates under the control of a control program, to move the means for extending and retracting 6 in either the up or down direction shown by two-headed arrow 10.

Controller 8 can be any suitable and/or desirable controller or computer that operates under the control of a software program in a manner known in the art to implement the present invention in the manner described hereinafter. Controller 8 desirably includes a microprocessor, computer storage, e.g., RAM, ROM, EPROM, magnetic disk storage, and the like, and an input/output system. Controller 8 can also include a media drive, such as a disk drive, CD-ROM drive, and the like, that can operate with a computer usable storage medium capable of storing all or part of the computer software which operates controller 8. Further details regarding controller 8 are not described herein for the purpose of simplicity.

The means for extending and retracting 6 can be any suitable and/or desirable electrical, mechanical, and/or hydraulic system that is capable of moving printer head assembly 4 in the directions shown by two-headed arrow 10 for the purpose of dispensing ink on a substrate 70. Further details regarding the means for extending and retracting 6 will not be described herein for the purpose of simplicity.

Figure 2:
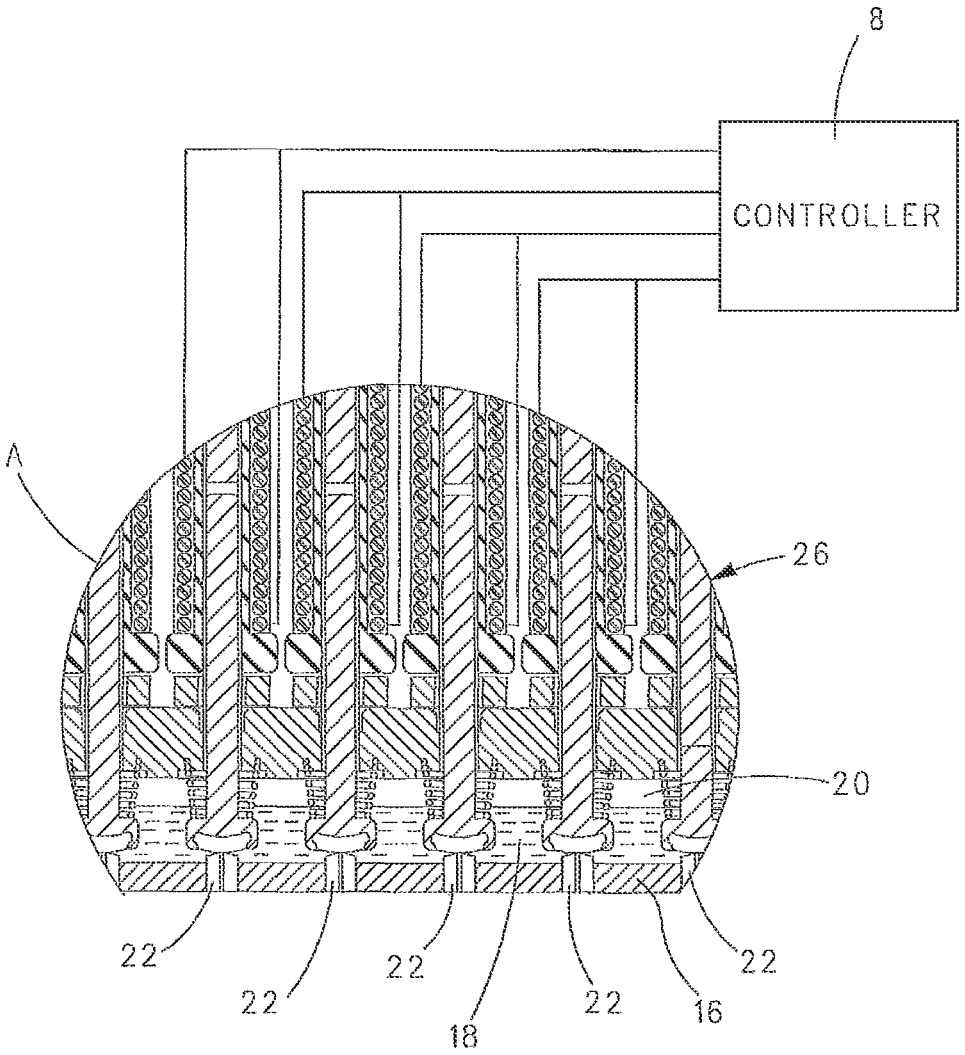
FIG. 2 is an enlarged view of detail A in FIG. 1.

With reference to FIG. 2 and with continuing reference to FIG. 1, printer head assembly 2 includes a support frame 12 comprising an upper plate 14 and a lower plate 16 coupled together in the manner shown in FIG. 1. Lower plate 16 includes therein a cavity 18 formed in the surface of lower plate 16 that fixes upper plate 14 when lower plate 16 and upper plate 14 are coupled together in the manner shown in FIG. 1.

A suitable seal or gasket 20 is disposed between the lower surface of upper plate 14 and the upper surface of lower plate 16 at least around the periphery of cavity 18 to form therewith a fluid seal that avoids the leakage of fluid, such as ink, from cavity 18 during the use of valve jet printer 2.

Figure 3:
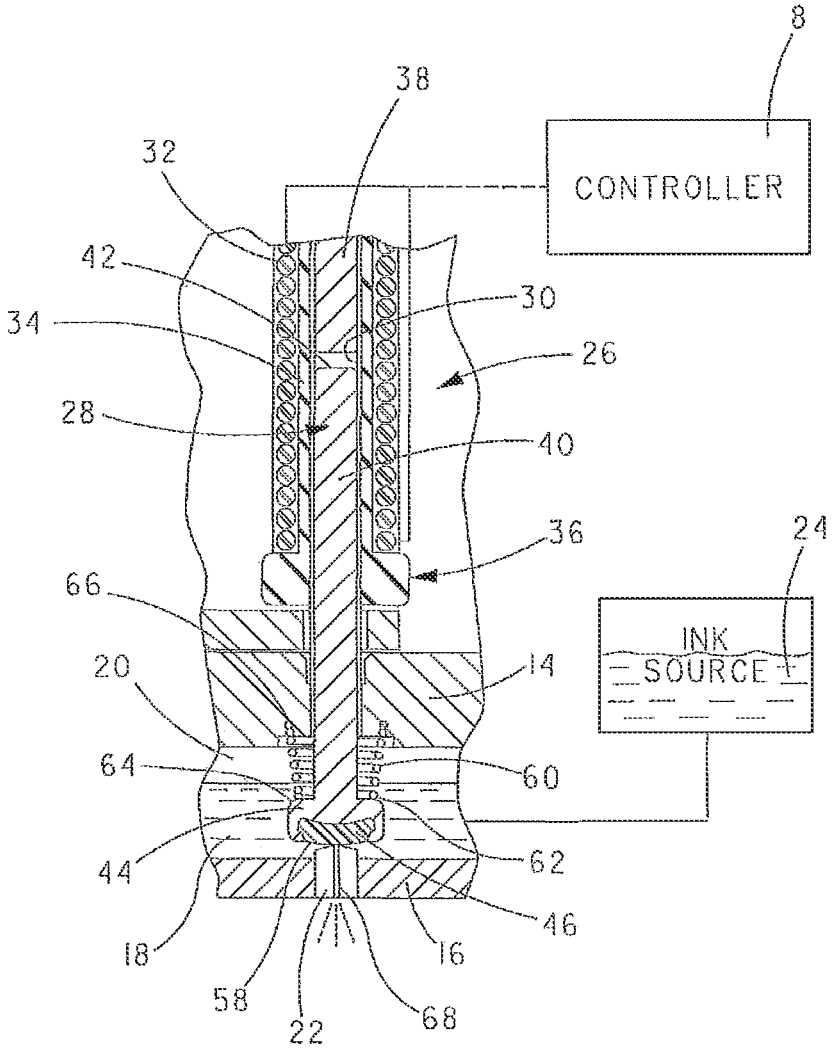
FIG. 3 is an isolated view of one of the ink jets shown in FIG. 7 in a closed state.

With reference to FIG. 3 and with continuing reference to FIGS. 1 and 2, in use of valve jet printer 2, cavity 18 is desirably filled with suitable ink that is capable of being applied to a substrate (not shown) in a manner described hereinafter via one or more nozzles 22 of valve jet printer 2. Ink can be included in cavity 18 in any suitable and/or desirable manner. In one non-limiting embodiment, cavity 18 receives ink from an ink reservoir 24 that is coupled in fluid communication with cavity 18 during operation of valve jet printer 2.

Valve jet printer 2 includes a number of so-called "jets" 26. Each jet 26 includes a nozzle 22, and a plunger rod 28 received in a sleeve 30 that is at least in part along the length of plunger rod 28 surrounded by a solenoid coil 32 which is spaced from sleeve 30 by an insulating sleeve 34. In the embodiment shown in FIG. 3, insulating sleeve 34 includes a wider base part 36 against which one end of solenoid coil 32 is positioned.

In the embodiment shown in FIG. 3, a stop 38 is positioned in sleeve 30 above plunger rod 28. As can be seen from comparing FIGS. 3 and 4, stop 38 acts to limit the distance that plunger rod 28 moves away from nozzle 22 in operation. By appropriately adjusting the position of stop 38, the overall travel length of plunger rod 28 in sleeve 30 can be set as desired to allow a predetermined amount of ink to be dispensed through nozzle 22 each time jet 26 is activated.

Figure 4:
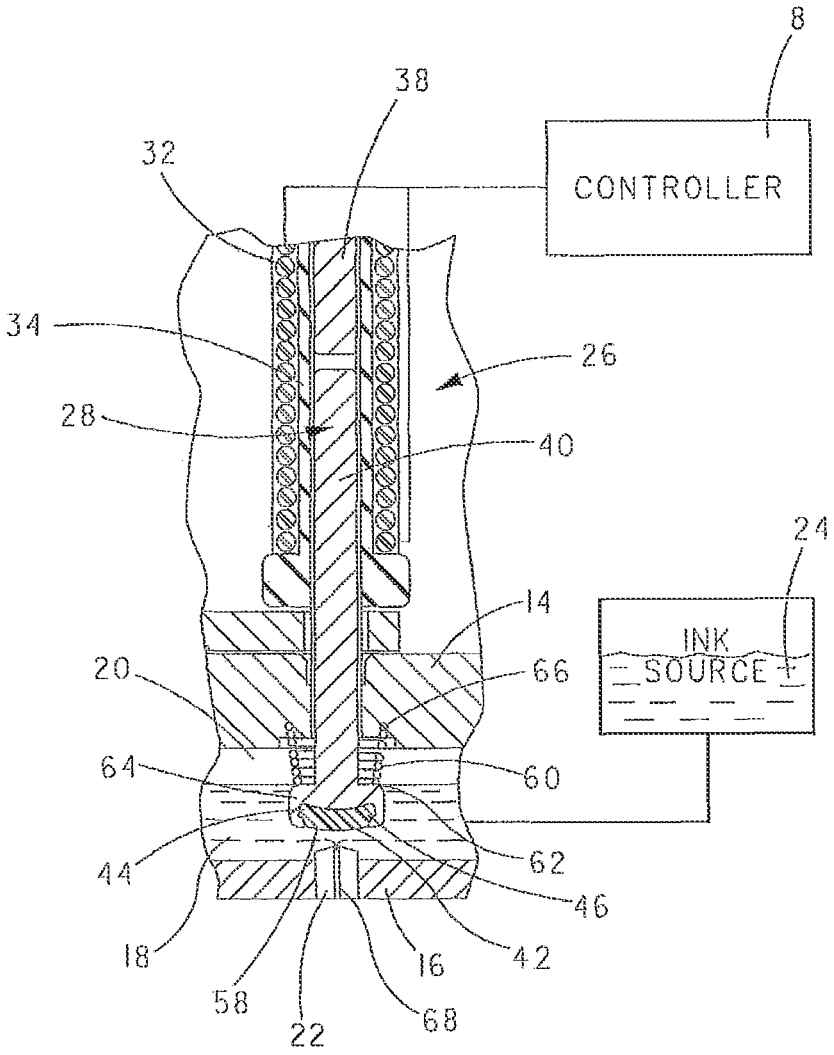
FIG. 4 is the ink jet of FIG. 3 in an open state.
Figure 5:
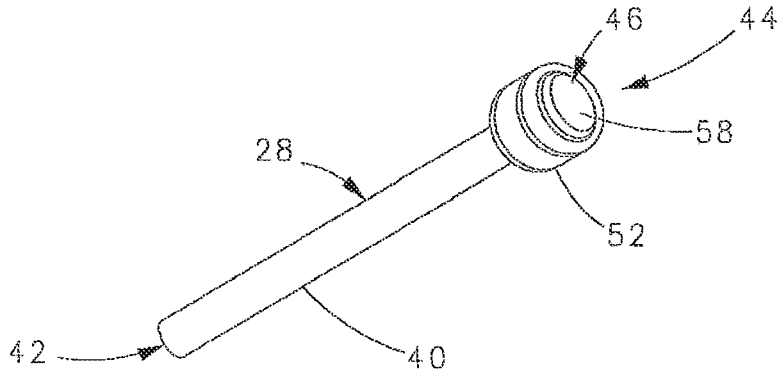
FIG. 5 is an isolated perspective view of the plunger rod of the ink jet shown in FIGS. 3 and 4.

With reference to FIG. 5 and with continuing reference to all previous figures, plunger rod 28 includes an elongated shank 40 configured to be received within sleeve 30 in the manner shown in FIGS. 3 and 4. Shank 40 has a first end 42 that is configured to be positioned adjacent stop 38 when shank 40 is disposed within sleeve 30. Shank 40 also has a second end 44 that is disposed in cavity 18 in use.

As can be seen in FIGS. 3-5, the second end 44 of shank 40 has a larger diameter than the first end 42 of shank 40 and the body of shank 40. Second end 44 of shank 40 includes a tip 46 desirably formed of a perfluoroelastomer (FFKM) that is particularly suitable and desirable for the present application. Details regarding the perfluoroelastomer material forming tip 46 will be described hereinafter.

Figure 6:
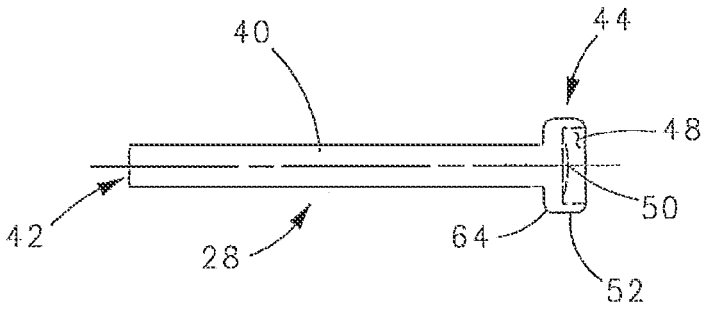
FIG. 6 is a side view of the shank of the plunger rod shown in FIG. 5 including in phantom a cup-shaped cavity at one end thereof.
Figure 7:
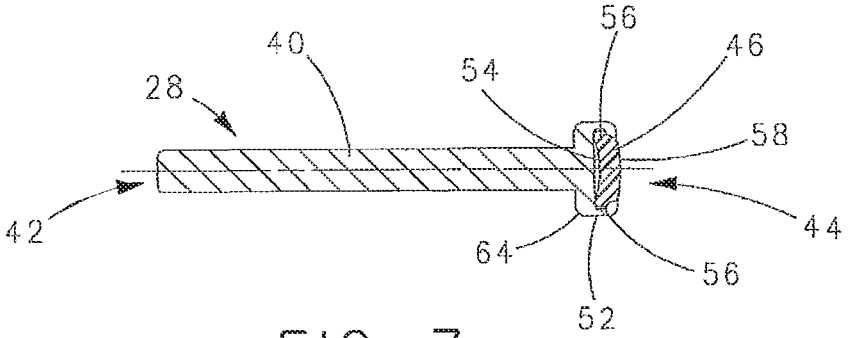
FIG. 7 is a cross-sectional view of the shank shown in FIG. 6 including a tip installed in the cup-shaped cavity.

With reference to FIGS. 6 and 7, second end 44 of shank 40 includes a cup-shaped cavity 48 having a convex bottom 50 and a circular side 52 that extends away from convex bottom 50 (to the right in FIG. 6). As can be seen in FIG. 7, tip 46 includes a concave base 54 that is complementary or substantially complementary to the shape of convex bottom 50 of second end 44, whereupon when tip 46 is inserted into cavity 48 in the manner shown in FIG. 7, the surfaces of convex bottom 50 and concave base 54 are substantially in contact.

As can be seen in FIG. 7, tip 46 also includes an annular flange 56 disposed around concave base 54. As can be seen by comparing FIGS. 6 and 7, to complete the assembly of tip 46 to cavity 48, circular side 52 is rolled over and into contact with annular flange 56 thereby securing tip 46 into cavity 48 as shown in FIG. 7. After completing the assembly of tip 46 into cavity 48, tip 46 will have an exposed surface 58 that moves into and out of contact with nozzle 22 in use of plunger rod 28 in the manner described hereinafter.

Desirably, plunger rod 28 is formed from a magnetically susceptible material or a material that has been processed to be magnetically susceptible. In one non-limiting embodiment, plunger rod 28 is formed from stainless steel that has been annealed at a temperature between 788-843° C. for two hours then cooled at a rate of 56° C. per hour to 727° C. in order to make plunger rod 28 magnetically susceptible. Desirably, plunger rod 28 is annealed in the presence of dry hydrogen or a vacuum to prevent oxidation of plunger rod 28 during annealing. Because of the solvent(s) that are used with the ink of valve jet printer 2, the use of stainless steel to form plunger rod 28 is desired to eliminate or avoid chemical attack of plunger rod 28 by said solvent(s).

With continuing reference to FIGS. 3 and 4, in use of plunger rod 28, shank 40 is slidably received in sleeve 30 with first end 42 positioned adjacent stop 38 and with second end 44 positioned in cavity 18. A spring 60 surrounding shank 40 adjacent second end 44 has a first end 62 resting against a shoulder 64 of second end 44. A second end 66 of spring 60 is secured in upper plate 14 in the manner shown in FIGS. 3 and 4. Spring 60 and shoulder 64 of second end 44 of shank 40 are arranged whereupon spring 60 biases surface 58 of tip 46 into contact with nozzle 22, especially an orifice 68 of nozzle 22 through which ink is dispensed from cavity 18 in operation of valve jet printer 2.

The operation of each jet 26 and, more particularly, each plunger 28 of valve jet printer 2 is controlled by controller 8. Specifically, when it is desired to maintain each jet 26 in its closed state, wherein no ink is being dispensed from said jet 26, controller 8 withholds electrical power from the solenoid coil 32 associated with said jet 26, whereupon spring 60 biases surface 58 of tip 46 into a sealing contact with orifice 68 of nozzle 22. The urging of surface 58 into contact with orifice 68 as shown in FIG. 3 prevents or avoids ink present in cavity 18 from passing into orifice 68.

On the other hand, when it is desired to dispense ink from nozzle 22, controller 8 causes electrical power to be supplied to solenoid coil 32. In response to being suitably energized with electrical power, solenoid coil 32 produces in sleeve 30 a magnetic field that interacts magnetically with shank 40, whereupon plunger rod 28 moves in a direction along its longitudinal axis from the position shown in FIG. 3 to the position shown in FIG. 4 whereupon surface 58 is spaced from orifice 68 thereby permitting ink present in cavity 18 to flow into orifice 68.

At a suitable time after controller 8 causes plunger rod 28 to move to the open position shown in FIG. 4, controller 8 terminates the supply of electrical power to solenoid coil 32 thereby terminating the magnetic field that caused plunger rod 28 to move from the position shown in FIG. 3 to the position shown in FIG. 4. In response to termination of this magnetic field, spring 60 biased against shoulder 64 of second end 44 of shank 40 urges second end 44 from the position shown in FIG. 4 back to the position shown in FIG. 3, whereupon surface 58 once again is in contact and, desirably, seals orifice 68 from the entry of ink into orifice 68 from ink present in cavity 18.

The rapid return of surface 58 of tip 46 from the open position shown in FIG. 4 to the closed position shown in FIG. 3 causes ink present in orifice 68 to be rapidly expelled therefrom in a manner known in the art.

With reference back to FIG. 1, in use of valve jet printer 2, substrate 70 and printer head assembly 4 are moved relative to each other, e.g., substrate 70 is moved in a direction normal to the illustration in FIG. 1 while valve jet printer 2 is held stationary, at a rate controlled by or known to controller 8. At the same time, controller 8 controls the operation of each jet 26 in a manner to cause ink to be dispensed from printer head assembly 4 onto substrate 70 in a predetermined pattern determined by the programming of controller 8. Desirably, controller 8 causes means for extending and retracting 6 to move printer head assembly into close proximity to substrate 70 during the dispensing of ink thereon and causes printer head assembly 4 to move away from substrate 70 after the desired pattern of ink has been dispensed thereon.

Desirably, tip 46 is formed from a material that resumes its original shape after compression against nozzle 22, and can withstand attack by the solvents used with the ink being dispensed by valve jet printer 2. In one particularly desirable embodiment, tip 46 is formed from a perfluoroelastomer (FFKM) which is known to be a chemically inert perfluoroelastomer having a structure composed of carbon, fluorine, and oxygen atoms. The perfluoroelastomer material forming tip 46 is made from perfluoroalkylpolyether in the range of 5-8% and perfluoroelastomer less than 97%. It may also include polyamide fibers less than 20%, polytetrafluoroethylene less than 20%, and/or microcrystalline silica less than 15%. This perfluoroelastomer exhibits outstanding high temperature properties and is the most chemically resistant elastomer available; effectively a rubber-like form of PTFE. It is superior to FKM elastomers, showing continuous dry-heat resistance to 260° C., with extended performance to 325° C. It is extremely inert chemically and shows excellent resistance to a majority of chemicals that attack other elastomers. Other notable properties include excellent resistance to oil-well sour gases, high temperature steam, low out gassing under vacuum, and good long-term high temperature compression set resistance.

The desired form of perfluoroelastomer utilized to form tip 46 has a Shore A hardness between 65 and 95, more desirably between 70 and 90 Shore A hardness; a tensile strength (lb/in$^2$) of approximately 2,000; a maximum continuous service temperature of 327° C.; and is flame resistant. It also has a 50% modulus of 15.5 MPa and a tensile strength at breaking of 22.75 MPa. It has an elongation at break of 75% and a compression set of 12% over 70 hours at 204° C., and 23% over 70 hours at 260° C. It also has a temperature of retraction, Tr10$^5$ at −5° C., and a surface smoothness between 20-50 micro inches. The thickness of tip 46 is desirably between 0.3 and 0.6 mm, and more desirably 0.5 mm.

As can be seen, the present invention is a valve jet printer 2 having a printer head assembly 4 that includes a number of jets 26. The embodiment of printer head assembly 4 illustrated in FIG. 1 includes a 1×16 linear array of jets 26. However, this is not to be construed as limiting the invention since it is envisioned that printer head assembly 4 can include any number and/or arrangement of jets 26 deemed suitable and/or desirable by one of ordinary skill in the art for a particular application. Each jet 26 includes a plunger rod made of a material that is either magnetically susceptible or which can be treated to be magnetically susceptible, and which is resistant to attack by the solvent(s) included in the ink present in cavity 18. Each plunger rod 28 further includes a tip 46 made of a perfluoroelastomer that is also resistant to attack by the solvent(s) included in the ink present in cavity 18.

This invention has been described with reference to exemplary embodiments. Obvious modifications and alterations will occur to others upon reading and understanding the preceding detailed description. It is intended that the invention be construed as including all such modifications and alterations insofar as they come within the scope of the appended claims or the equivalents thereof.

The invention claimed is:

1. An ink jet for a valve jet printer comprising:

a plunger rod having a shank and a tip, wherein the shank includes a first end and a second end at opposite ends thereof, and wherein the tip comprises a resilient, chemically inert material arranged at the second end of the shank.

2. The ink jet of claim 1, wherein the resilient, chemically inert material is a perfluoroelastomer.

3. The ink jet of claim 2, wherein the tip further comprises:

perfluoroalkylpolyether in the range between about 5 wt % to about 8 wt %;

less than 80 wt % perfluoroelastomer; and one or more of the following:

less than 20 wt % polyamide fibers;

less than 20 wt % polytetrafluoroethylene; and less than 15 wt % microcrystalline silica.

4. The ink jet of claim 1, wherein the tip has one or more of the following properties:

a Shore A hardness between 65 and 95;

a tensile strength of approximately 2,000 lb/in$^2$;

a maximum continuous service temperature of approximately 325° C.;

a 50% modulus of 15.5 MPa;

a tensile strength at break of 22.75 MPa;

an elongation at break of 75%; and a compression set of 12% for 70 hours at 204° C., or 23% at 70 hours at 260° C.

5. The ink jet of claim 1, wherein the second end of the shank comprises a cup-shaped cavity having a convex bottom and a circular side; and wherein the tip comprises a concave base and an annular flange configured to contact the second end of the shank.

6. A valve jet printer comprising:

a frame defining an ink cavity; and a plurality of ink jets supported by the frame, wherein each ink jet comprises a plunger rod having a shank and a tip, wherein the shank includes a first end and a second end at opposite ends thereof, wherein the tip comprises a resilient, chemically inert material arranged at the second end of the shank.

7. The valve jet printer of claim 6, wherein the resilient, chemically inert material is a perfluoroelastomer.

8. The valve jet printer of claim 7, wherein the tip comprises:

perfluoroalkylpolyether in the range between about 5 wt % to about 8 wt %;

less than 80 wt % perfluoroelastomer; and one or more of the following:

less than 20 wt % polyamide fibers;

less than 20 wt % polytetrafluoroethylene; and less than 15 wt % microcrystalline silica.

9. The valve jet printer of claim 6, wherein the shank is formed of stainless steel that has been heat treated to make the shank magnetically susceptible.

10. The valve jet printer of claim 9, further comprising:

a nozzle including an orifice extending therethrough; and a spring biasing the magnetically susceptible shank toward a nozzle.

11. The valve jet printer of claim 10, further comprising a solenoid coil having a bore that receives at least the first end of the shank therein, wherein:

absent electrical power being supplied to the solenoid coil, the spring biases the tip into contact with the orifice of the nozzle; and in response to electrical power being supplied to the solenoid coil, the tip moves away from the orifice of the nozzle against the bias of the spring.

12. The valve jet printer of claim 10, wherein:

in response to the spring biasing the tip into contact with the orifice of the nozzle, the tip deforms from its original shape to form a seal with the orifice of the nozzle; and in response to the tip moving away from the orifice of the nozzle, the tip resumes its original shape.

13. An ink jet for a valve jet printer comprising:

a plunger rod having a shank and a tip, wherein the shank includes a first end and a second end at opposite ends thereof, and wherein the tip comprises a concave base and an annular flange configured to contact the second end of the shank.

14. The ink jet of claim 13, wherein the second end of the shank comprises a cup-shaped cavity having a convex bottom and a circular side, wherein in an assembled state of the tip and the second end of the shank, the concave base of the tip contacts the convex bottom of the cup-shaped cavity, and an end of the circular side opposite the convex bottom contacts the annular flange, thereby securing the tip in the cup-shaped cavity.

15. The ink jet of claim 13, wherein the tip further comprises:

perfluoroalkylpolyether in the range between about 5 wt % to about 8 wt %;

less than 80 wt % perfluoroelastomer; and one or more of the following:

less than 20 wt % polyamide fibers;

less than 20 wt % polytetrafluoroethylene; and less than 15 wt % microcrystalline silica.

16. The ink jet of claim 13, wherein the tip has one or more of the following properties:

a Shore A hardness between 65 and 95;

a tensile strength of approximately 2,000 lb/in$^2$;

a maximum continuous service temperature of approximately 325° C.;

a 50% modulus of 15.5 MPa;

a tensile strength at break of 22.75 MPa;

an elongation at break of 75%; and a compression set of 12% for 70 hours at 204° C., or 23% at 70 hours at 260° C.

17. The ink jet of claim 13, wherein the tip is configured to contact and form a seal with a nozzle of the valve jet printer, wherein:

in response to a spring biasing the tip into contact with an orifice of the nozzle, the tip is configured to be deformed from its original shape to form a seal with the orifice of the nozzle; and in response to the tip moving away from the orifice of the nozzle, the tip is configured to resume its original shape.

18. A valve jet printer comprising:

a frame defining an ink cavity; and a plurality of ink jets supported by the frame, each ink jet comprising a plunger rod having a shank and a tip, wherein the shank includes a first end and a second end at opposite ends thereof, and wherein the tip comprises a concave base and an annular flange configured to contact the second end of the shank.

19. The valve jet printer of claim 18, wherein the second end of the shank comprises a cup-shaped cavity having a convex bottom and a circular side, wherein in an assembled state of the tip and the second end of the shank, the concave base of the tip contacts the convex bottom of the cup-shaped cavity, and an end of the circular side opposite the convex bottom contacts the annular flange, thereby securing the tip in the cup-shaped cavity.

20. The valve jet printer of claim 18, wherein the tip further comprises:

perfluoroalkylpolyether in the range between about 5 wt % to about 8 wt %;

less than 80 wt % perfluoroelastomer; and one or more of the following:

less than 20 wt % polyamide fibers;

less than 20 wt % polytetrafluoroethylene; and less than 15 wt % microcrystalline silica.

21. The valve jet printer of claim 18, wherein the shank is formed of stainless steel that has been heat treated to make the shank magnetically susceptible.

22. The valve jet printer of claim 21, further comprising:

a nozzle including an orifice extending therethrough; and a spring biasing the magnetically susceptible shank toward a nozzle.

23. The valve jet printer of claim 22, further comprising a solenoid coil having a bore that receives at least the first end of the shank therein, wherein:

absent electrical power being supplied to the solenoid coil, the spring biases the tip into contact with the orifice of the nozzle; and in response to electrical power being supplied to the solenoid coil, the tip moves away from the orifice of the nozzle against the bias of the spring.

24. The valve jet printer of claim 22, wherein:

in response to the spring biasing the tip into contact with the orifice of the nozzle, the tip deforms from its original shape to form a seal with the orifice of the nozzle; and in response to the tip moving away from the orifice of the nozzle, the tip resumes its original shape.

* * * * *